US011946274B2

(12) United States Patent
Miller et al.

(10) Patent No.: US 11,946,274 B2
(45) Date of Patent: Apr. 2, 2024

(54) INFLATABLE STRUCTURE AND METHOD OF TRANSPORTING AN INFLATABLE STRUCTURE

(71) Applicant: Dawsongroup PLC, Milton Keynes (GB)

(72) Inventors: Steve Miller, Whittlebury (GB); David Harris Kelsall, Oswestry (GB); Stephen Clinton Casselman, Shrewsbury (GB)

(73) Assignee: Dawsongroup PLC, Milton Keynes (GB)

( * ) Notice: Subject to any disclaimer, the term of this patent is extended or adjusted under 35 U.S.C. 154(b) by 369 days.

(21) Appl. No.: 17/147,949

(22) Filed: Jan. 13, 2021

(65) Prior Publication Data

US 2021/0214962 A1 Jul. 15, 2021

(30) Foreign Application Priority Data

Jan. 14, 2020 (GB) ..... 2000525

(51) Int. Cl.
*E04H 15/20* (2006.01)
*E04H 15/02* (2006.01)

(52) U.S. Cl.
CPC ..... *E04H 15/20* (2013.01); *E04H 15/02* (2013.01); *E04H 2015/204* (2013.01); *E04H 2015/206* (2013.01); *E04H 2015/207* (2013.01)

(58) Field of Classification Search
CPC ... E04H 15/20; E04H 15/56; E04H 2015/204; E04H 2015/206; E04H 2015/207;
(Continued)

(56) References Cited

U.S. PATENT DOCUMENTS 2,782,794 A * 2/1957 White ..... E04H 15/20 52/2.19
2,830,606 A * 4/1958 Daugherty ..... E04H 15/20 52/2.14

(Continued)

FOREIGN PATENT DOCUMENTS

CN 104196122 A 12/2014
CN 207017757 U 2/2018

(Continued)

OTHER PUBLICATIONS 13 page PDF of machine translation of WO 2018/147750. (Year: 2018).*

(Continued)

*Primary Examiner* — Robert Canfield
(74) *Attorney, Agent, or Firm* — Myers Wolin, LLC

(57) ABSTRACT

A structure is provided having a floor, and a canopy made from a flexible, substantially air-impermeable material and having a tubular rib. The canopy has an air inlet port by which the interior of the tubular rib can be connected to a source of compressed air, and is movable by the supply of compressed air from a collapsed state in which the tubular rib is deflated to an inflated state in which the tubular rib is inflated and supports the canopy in such a way that the canopy encloses an interior space above the floor and forms a roof and side walls of the structure. The floor has three substantially rigid floor panels which may be arranged together to form a substantially planar floor, or connected together to form the base and sides of a container in which the canopy can be stored when in the collapsed state.

6 Claims, 5 Drawing Sheets

(58) Field of Classification Search
CPC ..... E04H 1/12; E04B 1/343; E04B 1/34357; E04B 1/344
USPC ..... 52/2.13, 2.17, 2.18, 2.22, 2.23, 71, 79.5; 135/124, 126, 136, 900–902, 906
See application file for complete search history.

(56) References Cited

U.S. PATENT DOCUMENTS

| | | | | |
|---|---|---|---|---|
| 2,854,014 | A * | 9/1958 | Hasselquist | E04H 15/20 441/40 |
| 3,247,627 | A * | 4/1966 | Bird | E04H 15/20 D25/19 |
| 3,497,606 | A * | 2/1970 | Andrews | E04H 15/20 D25/19 |
| 4,004,380 | A * | 1/1977 | Kwake | E04H 15/20 D25/16 |
| 4,631,873 | A * | 12/1986 | Parish | E04H 15/20 52/2.21 |
| 5,097,548 | A * | 3/1992 | Heck | E04H 15/20 5/482 |
| 5,205,089 | A * | 4/1993 | Cunningham | E04H 15/06 135/132 |
| 5,226,261 | A * | 7/1993 | Wilbourn | B60J 7/1256 52/2.21 |
| 5,285,604 | A * | 2/1994 | Carlin | E04H 1/1205 52/36.2 |
| D549,836 | S * | 8/2007 | Desbiens | D25/19 |
| 8,001,985 | B1 * | 8/2011 | Conner | E04H 15/56 135/96 |
| 8,001,986 | B2 | 9/2011 | Curtsinger | |
| 8,011,986 | B1 * | 9/2011 | Curtsinger | E04H 15/20 441/35 |
| 8,752,336 | B1 * | 6/2014 | Ozsuer | E04H 9/028 52/2.18 |
| 9,829,896 | B1 * | 11/2017 | Arend | F24F 13/0209 |
| 10,132,100 | B1 * | 11/2018 | Akad | E04D 13/106 |
| 11,193,299 | B2 * | 12/2021 | Andre | E04H 15/20 |
| 2003/0061777 | A1 * | 4/2003 | Alderman | E04B 1/76 52/406.1 |
| 2003/0098054 | A1 * | 5/2003 | Yang | E04H 6/04 52/2.13 |
| 2003/0116182 | A1 * | 6/2003 | Ueda | E04H 15/20 135/124 |
| 2003/0213512 | A1 * | 11/2003 | Lee | E04H 15/20 135/126 |
| 2008/0264461 | A1 * | 10/2008 | Harris | E04H 15/32 135/120.1 |
| 2009/0217592 | A1 | 9/2009 | Tashima et al. | |
| 2010/0146868 | A1 * | 6/2010 | Lukasiewicz | E04H 15/18 52/741.1 |
| 2013/0068851 | A1 * | 3/2013 | Young | A61M 35/25 52/2.13 |
| 2013/0074424 | A1 * | 3/2013 | Trascher | E04H 1/02 52/79.5 |
| 2013/0104947 | A1 * | 5/2013 | Hotes | E04H 15/34 135/96 |
| 2013/0305626 | A1 * | 11/2013 | Strickland | E04B 1/34357 52/79.5 |
| 2014/0311051 | A1 * | 10/2014 | Fagan | E04H 1/005 52/79.5 |
| 2015/0017897 | A1 * | 1/2015 | Wiliams | E04H 1/1205 454/51 |
| 2018/0187409 | A1 * | 7/2018 | Williams | G01N 21/8803 |
| 2020/0079199 | A1 * | 3/2020 | Blueford | E04H 15/20 |
| 2020/0224406 | A1 * | 7/2020 | Brezan | E04B 1/3444 |
| 2020/0332551 | A1 * | 10/2020 | Klappe | E04H 15/20 |
| 2021/0215041 | A1 * | 7/2021 | Scherba | E21D 9/14 |
| 2021/0236366 | A1 * | 8/2021 | Serrano | A61G 10/023 |
| 2021/0301549 | A1 * | 9/2021 | Williams | E04H 15/22 |

FOREIGN PATENT DOCUMENTS

| | | | | |
|---|---|---|---|---|
| FR | 2634184 | A1 * | 9/1990 | |
| GB | 1021312 | | 3/1966 | |
| GB | 2135354 | A * | 8/1984 | E04H 15/20 |
| GB | 2368599 | A * | 5/2002 | E04H 15/20 |
| JP | 2-161082 | A | 6/1990 | |
| JP | H02161082 | A | 6/1990 | |
| JP | 2007132629 | A * | 5/2007 | |
| JP | 2010054167 | A * | 3/2010 | E04H 15/10 |
| KR | 102007123 | B1 | 8/2019 | |
| SU | 1147081 | A1 | 1/1992 | |
| WO | 2012/034011 | A2 | 3/2012 | |
| WO | 2018147750 | A1 | 8/2018 | |

OTHER PUBLICATIONS 3 page PDF of machine translation of JP 2-161082. (Year: 1990).*
7 page PDF of machine translation of KR 10-2007123. (Year: 2019).*
Extended European search report with the Partial European search report and the European search opinion issued by the European Patent Office for corresponding European Patent Application No. 21151026.8-1002, dated Sep. 29, 2021.
Search Report for corresponding UK Patent Application No. GB2000525.2, claims 1-21, dated Jun. 19, 2020.
Further Search Report for corresponding UK Patent Application No. GB2000525.2, claims 22-24, dated Jan. 12, 2021.
Further Search Report for corresponding UK Patent Application No. GB2000525.2, claim 25, dated Jan. 12, 2021.
1 Search Report for corresponding UK Patent Application No. GB2000525.2 dated Jun. 19, 2020.

* cited by examiner

INFLATABLE STRUCTURE AND METHOD OF TRANSPORTING AN INFLATABLE STRUCTURE

CROSS REFERENCE TO RELATED APPLICATIONS

This application claims priority to UK Patent Application No. GB 2000525.2, filed Jan. 14, 2020, the contents of which are incorporated by reference herein.

TECHNICAL FIELD

The present invention relates to an inflatable structure, particularly, but not exclusively to an insulated inflatable building, and to a method of transporting an inflatable structure.

BACKGROUND

It is known to use inflatable structures to provide, temporary buildings for events such as festivals, exhibitions, events or stage shows. Such structures typically comprise a canopy which is formed from a flexible, air impermeable material, which forms a plurality of interconnected tubular ribs. The tubular ribs are connected to a source of compressed air so that they inflate and form arches which support the canopy to provide the roof and walls of the structure. Alternatively, the inflatable structure may have a more conventional shape, having inflatable side walls and a gable or hipped roof, as disclosed in US20090217598, for example.

SUMMARY

It is an object of the present invention to provide a new configuration of inflatable structure, and new method of transporting an inflatable structure, which are particularly suitable for use in providing a temporary cold storage facility. A temporary refrigerated storage facility may, for example, be required for cold storing food or beverages for sale or distribution at a festival, exhibition or event, or for storing food or medicines, for example during aid efforts in disaster zones or impoverished areas.

According to one embodiment we provide a structure comprising a floor, and a canopy made from a flexible, substantially air-impermeable material and having at least one tubular rib, the canopy being further provided with an air inlet port by means of which the interior of the tubular ribs can be connected to a source of compressed air, and being movable by the supply of compressed air to the tubular rib via the air inlet port from a collapsed state in which the tubular rib is deflated to an inflated state in which the tubular rib is inflated and supports the canopy in such a way that the canopy encloses an interior space above the floor and forms a roof and side walls of the structure, wherein the floor comprises three substantially rigid floor panels which may be arranged together to form a substantially planar floor, or connected together to form the base and sides of a container in which the canopy can be stored when in the collapsed state.

Preferably the floor panels are connected together by a hinge mechanism, the hinge mechanism being operable such that the panels can be pivoted relative to one another between an open configuration in which they form a substantially planar floor, and a closed configuration in which they form the base and sides of a container in which the canopy can be stored when in the collapsed state.

The structure may comprise five rigid floor panels which when in the closed configuration form a base and four sides of the container.

The rigid floor panels may be substantially square or rectangular and when in the closed configuration form a container which encloses a cuboidal volume.

The structure may comprise six rigid floor panels which when in the closed configuration for a base, four sides, and a lid of the container.

The canopy may be secured to the floor panels.

The structure may comprise canopy fasteners by means of which the canopy may be releasably secured to the periphery of the floor when the floor panels are in their open configuration.

The structure may comprise a plurality of tubular ribs which are parallel and adjacent to one another and which, when the canopy is in its inflated state form an arch so that the tubular ribs form the roof and two opposite side walls of the structure. In this case, two further opposite side walls, hereinafter referred to as end walls, of the structure may be formed by portions of canopy which do not have inflatable ribs. One or both of the end walls may be releasably connected to the side walls and roof, for example by means of hook and loop fasteners such as Velcro®.

The structure may further be provided with a pressure sensor which is arranged so as to provide pressure signals indicative of the air pressure in the tubular rib, a processor which is connected to the pressure sensor to receive pressure signals from the pressure sensor, and a source of pressurised air, the processor being programmed to operate initiate supply of pressurised air from the source of pressurised air to the interior of the tubular rib if the pressure in the interior of the tubular rib falls below a pre-determined lower threshold, and to cease the supply of pressurised air from the source of pressurised air to the interior of the tubular rib when the pressure in the interior of the tubular rib reaches a pre-determined upper threshold.

The structure may further be provided with a pressure relief valve which is configured to allow air to be exhausted from the interior of the tubular rib if the pressure in the interior of the tubular rib falls above a pre-determined upper threshold, and to stop the release of air from the interior of the tubular rib when the pressure in the interior of the tubular rib reaches a pre-determined lower threshold.

In this case, the structure may further comprise a source of pressurised air, and a pressure operated switch which is configured to initiate supply of pressurised air from the source of pressurised air to the interior of the tubular rib if the pressure in the interior of the tubular rib falls below a second pre-determined lower threshold, and to cease the supply of pressurised air from the source of pressurised air to the interior of the tubular rib when the pressure in the interior of the tubular rib reaches a second pre-determined upper threshold.

A rib insulating layer may be provided in the interior of each rib.

The ribs may be made from a flexible polymer sheet.

The rib insulating layer is advantageously made from a flexible material.

It may comprise a polymeric fleece or felt which is sandwiched between two reflective foil layers. The foil layers may be metallic or metal coated foils.

The canopy may be made from a polymer such as polyvinyl chloride.

Where provided, the end walls may be double layered, and comprise a polymeric skin with a thermally insulating lining.

A door may be provided in one of the end panels.

The floor panels may be made from two parallel outer skin panels with a layer of thermally insulating material therebetween. The skin panels may be made from plywood. The insulating material may be made from a polymer and may have an open or closed cell structure. The insulating material may be made from a woven or non-woven fibrous material.

The structure may further comprise a refrigeration apparatus which is operable to extract air from the interior space, cool the extracted air, and then return the cooled air to the interior space.

The structure may be provided with a refrigeration port and a coupling by means of which the refrigeration apparatus may be placed outside the interior space but connected to the interior space so that the refrigeration apparatus can be operated to extract and cool air from the interior space, and return the cooled air to the interior space.

The floor may have an upper surface which is adjacent the interior space of the structure, and a lower surface which is, when the structure is in use, adjacent the ground, the structure being further provided with at least two support rails which are secured to the lower surface of the floor and which, when the structure is in use, are configured to engage with the ground and support the floor so that it is spaced from the ground. The support rails may be spaced from and parallel to one another.

Advantageously, at least two support rails are secured to the floor panel which forms the base of the container. More preferably, however, at least two support rails are secured to each floor panel so that each floor panel is supported spaced from the ground by the support rails.

The support rails may be metallic, and may, for example be made from extruded aluminium.

The structure may further be provided with container fasteners, such as straps or clips, which are operable to secure the floor panels in the closed configuration, and which are releasable to allow the floor panels to be pivoted to the open configuration.

According to another embodiment we provide a method of transporting a structure according to the first embodiment of the invention, wherein the method comprises bringing the canopy to its collapsed state, moving the floor panels to their closed configuration, and stowing the canopy in the container formed by the floor panels.

Where the floor of the structure has an upper surface which is adjacent the interior space of the structure, and a lower surface which is, when the structure is in use, adjacent the ground, and the structure is further provided with at least two support rails which are secured to the lower surface of the floor and which, when the structure is in use, are configured to engage with the ground and support the floor so that it is spaced from the ground, the two support rails being secured to the floor panel which forms the base of the container, the method may further comprise lifting the container and stowed canopy using a vehicle with lifting forks, by moving the lifting forks into the space between the enclosed by the support rails, the ground and the lowermost surface of the floor panel which forms the base of the container, and then moving the lifting forks away from the ground.

The method according to the second embodiment of the invention may comprise the transporting of a structure having any feature or combination of features of the structure according to the embodiment described above.

According to another embodiment we provide a structure comprising a floor, and a canopy made from a flexible, substantially air-impermeable material and having at least one tubular rib, the canopy being further provided with an air inlet port by means of which the interior of the tubular ribs can be connected to a source of compressed air, and being movable by the supply of compressed air to the tubular rib via the air inlet port from a collapsed state in which the tubular rib is deflated to an inflated state in which the tubular rib is inflated and supports the canopy in such a way that the canopy encloses an interior space above the floor and forms a roof and side walls of the structure, wherein a rib insulating layer is provided in the interior of each rib.

The ribs may be made from a flexible polymer sheet.

The rib insulating layer is advantageously made from a flexible material. It may comprise a polymeric fleece or felt which is sandwiched between two reflective foil layers. The foil layers may be metallic or metal coated foils.

Each tubular rib may have an interior skin which faces the interior space enclosed by the canopy, and an exterior skin which faces the exterior of the structure, the space between the interior skin and exterior skin forming the interior of the tubular rib, the exterior surface of the exterior skin being provided with reflective coating.

The interior surface of the exterior skin may be provided with a coating to reduce transmission of solar energy through the exterior skin into the interior of the tubular rib.

According to another embodiment we provide a structure comprising a floor, and a canopy made from a flexible, substantially air-impermeable material and having at least one tubular rib, the canopy being further provided with an air inlet port by means of which the interior of the tubular ribs can be connected to a source of compressed air, and being movable by the supply of compressed air to the tubular rib via the air inlet port from a collapsed state in which the tubular rib is deflated to an inflated state in which the tubular rib is inflated and supports the canopy in such a way that the canopy encloses an interior space above the floor and forms a roof and side walls of the structure, wherein the structure is further provided with a pressure sensor which is arranged so as to provide pressure signals indicative of the air pressure in the tubular rib, a processor which is connected to the pressure sensor to receive pressure signals from the pressure sensor, and a source of pressurised air, the processor being programmed to operate initiate supply of pressurised air from the source of pressurised air to the interior of the tubular rib if the pressure in the interior of the tubular rib falls below a pre-determined lower threshold, and to cease the supply of pressurised air from the source of pressurised air to the interior of the tubular rib when the pressure in the interior of the tubular rib reaches a pre-determined upper threshold.

According to another embodiment we provide a structure comprising a floor, and a canopy made from a flexible, substantially air-impermeable material and having at least one tubular rib, the canopy being further provided with an air inlet port by means of which the interior of the tubular ribs can be connected to a source of compressed air, and being movable by the supply of compressed air to the tubular rib via the air inlet port from a collapsed state in which the tubular rib is deflated to an inflated state in which the tubular rib is inflated and supports the canopy in such a way that the canopy encloses an interior space above the floor and forms a roof and side walls of the structure, wherein the structure is further provided with a pressure relief valve which is configured to allow air to be exhausted from the interior of the tubular rib if the pressure in the interior of the tubular rib falls above a pre-determined upper threshold, and to stop the release of air from the interior of the tubular rib when the pressure in the interior of the tubular rib reaches a pre-determined lower threshold.

In this case, the structure may further comprise a source of pressurised air, and a pressure operated switch which is configured to initiate supply of pressurised air from the source of pressurised air to the interior of the tubular rib if the pressure in the interior of the tubular rib falls below a second pre-determined lower threshold, and to cease the supply of pressurised air from the source of pressurised air to the interior of the tubular rib when the pressure in the interior of the tubular rib reaches a second pre-determined upper threshold.

BRIEF DESCRIPTION OF THE DRAWINGS

Embodiments of the invention will now be described, by way of example only, with reference to the following figures, of which.

DETAILED DESCRIPTION

Figure 1:
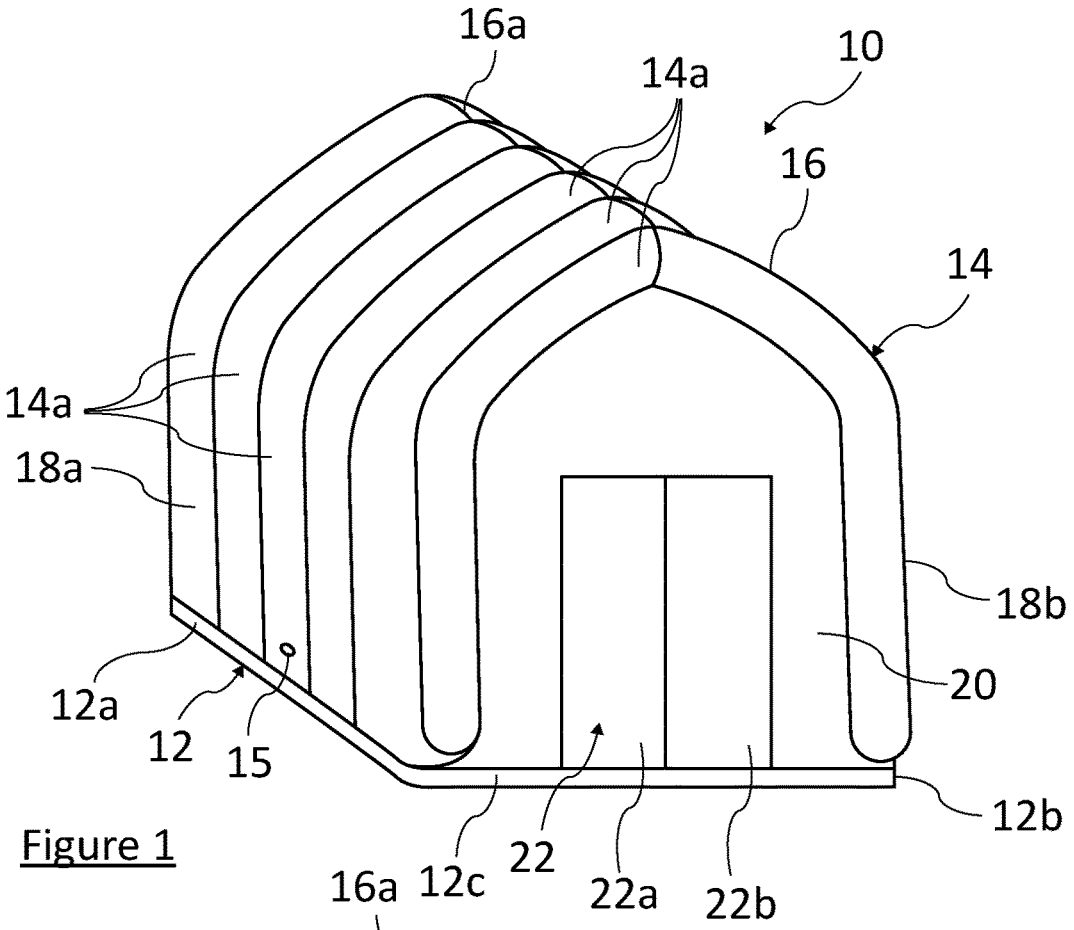
FIG. 1 is a perspective view of a structure according to the first, third, fourth and fifth embodiments of the invention with the floor panels in their open configuration and the canopy in its inflated state.

Referring now to FIG. 1, there is shown a structure 10 comprising a floor 12, and a canopy 14 made from a flexible, substantially air-impermeable material, and having a plurality of tubular ribs 14*a*. The canopy 14 is advantageously made from a polymer, for example comprising polyvinyl chloride (PVC). Specifically, in this example, the canopy 14 is made from a woven polyester base cloth which is coated on both sides with a PVC coating to provide the necessary impermeability. A top coating of lacquer may also be present to protect the PVC coating and to improve the ease of cleaning of the structure. Examples of suitable materials are the Valmex® products made by Low & Bonar GmbH company, Mehler Texnologies.

The canopy 14 is further provided with an air inlet port 15 by means of which the interior of the tubular ribs 14*a* can be connected to a source of compressed air such as a pump. The canopy 14 is movable by the supply of compressed air to the tubular ribs 14*a* via the air inlet port 15 from a collapsed state, in which the tubular ribs 14*a* are deflated, to an inflated state in which the tubular ribs 14*a* are inflated and supports the canopy 14 in such a way that the canopy 14 encloses an interior space above the floor 12 and forms a roof 16 and side walls 18*a*, 18*b*, 20 of the structure 10.

In this example, the canopy 14 is provided with six tubular ribs 14*a*, but it will be appreciated that this need not be the case, and more or fewer than six could be provided depending on the size and shape of the structure. In this example, the tubular ribs are parallel and adjacent to one another and extend from one edge 12*a* of the floor 12 to an opposite edge 12*b* of the floor 12. They are configured such that, when the canopy 14 is in its inflated state, they form an arch which extends over the floor 12, from the first edge 12*a* of the floor 12 to the second, opposite, edge 12*b* of the floor 12. Consequently, the tubular ribs 14*a* form the roof 16 and two opposite side walls 18*a*, 18*b* of the structure. In this example, the tubular ribs 14*a* are shaped such that they extend upwardly from the edges 12*a*, 12*b* of the floor 12, generally perpendicular to the floor, so as to form side walls 18*a*, 18*b* which are generally planar and lie generally perpendicular to the floor 12. The roof 16 comprises a ridge 16*a*, which lies generally centrally between the two side walls 18*a*, 18*b*, and four generally planar inclined portions—two on either side of the ridge 16*a*. It should be appreciated that this need not be the case, however. The tubular ribs 14*a*, could, for example, be configured to provide two planar, upright side walls, whilst the roof 16 is curved, or tubular ribs form a continuous, parabolic arch so that both the side walls and roof are curved. The tubular ribs 14*a* need not extend all the way from one edge 12*a* of the floor 12 to the opposite edge 12*b* of the floor. For example, one side wall 18*a* and the adjacent half of the roof 20 may be formed from a first set of tubular ribs 14*a*, whilst the other side wall 18*b* and the other half of the roof 20 are formed from a second set of the tubular rib 14*a*, the two sets of tubular ribs 14*a* being connected at the ridge 16*a* of the roof 16. Alternatively, the tubular ribs could lie generally parallel to the floor 12 and be stacked in a generally vertical stack to form the side walls Although the two further opposite side walls 20, hereinafter referred to as end walls 20, of the structure 10 may also contain tubular ribs 14*a*, in this case, they are formed by portions of canopy 14 which do not have inflatable ribs. The end walls 20 are releasably connected to the side walls 18*a*, 18*b* and roof 20, in this example by means of hook and loop fasteners such as Velcro®.

Figure 2:
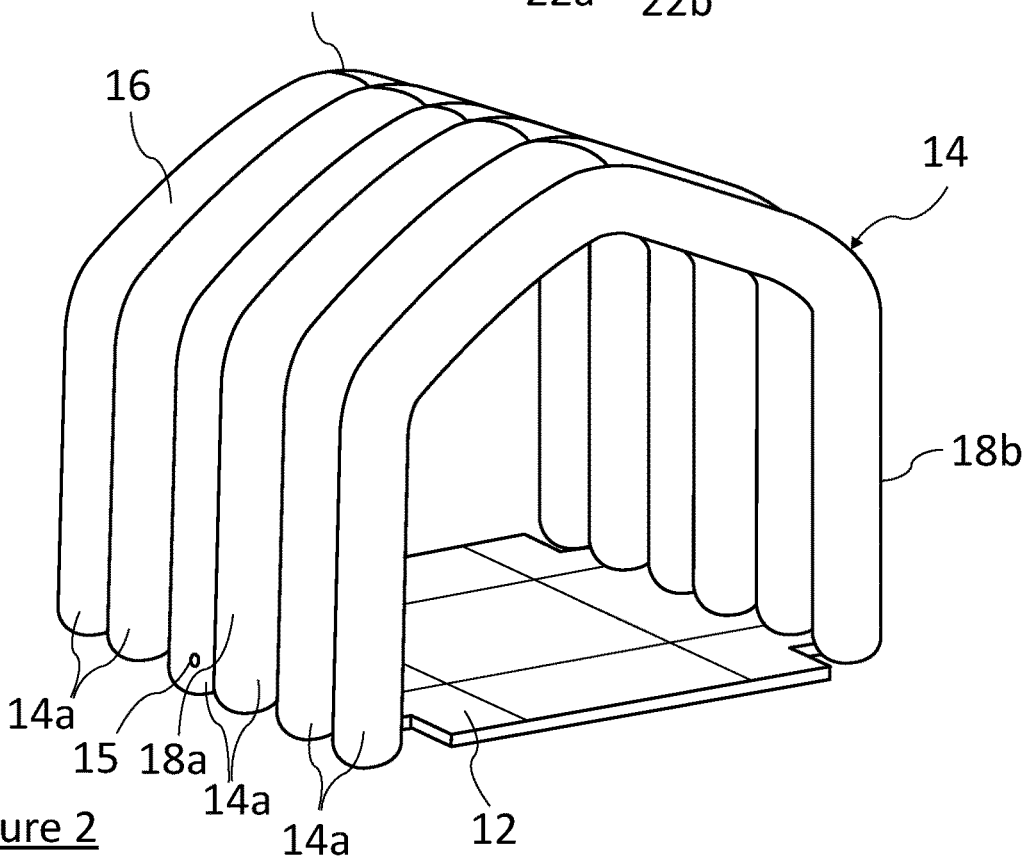
FIG. 2 is a perspective view of the structure illustrated in FIG. 1 with the end walls removed to show the interior of the structure.

In this embodiment, the tubular ribs 14*a* at each end of the enclosure (directly adjacent the end walls 20) have a significantly larger diameter, than the other ribs 14*a* to assist in supporting the end walls 20. This is illustrated in FIG. 2.

One of the end walls 20 is provided with a doorway 22 to provide an entrance whereby a person can enter the interior space of the structure 10. In this example the doorway is a generally rectangular aperture which is closed by means of two generally rectangular doors 22*a*, 22*b* which are formed from the same flexible, air impermeable material as the rest of the end wall 20.

In this example, first edge of each door 22*a*, 22*b* is pivotally connected to one of two vertical edges of the doorway 20. Fasteners, in this example hook and loop fasteners, are provided to secure top horizontal edges of the doors to a top horizontal edge of the doorway 22, and to secure a second vertical edge one door 22*a* to a second, vertical, edge of the other door 22*b*. In this example, each door 22*a*, 22*b* is integral with the remainder of the end wall 20.

The doorway 22 could, however, be a simple vertical slit in the end wall 20.

Figure 3:
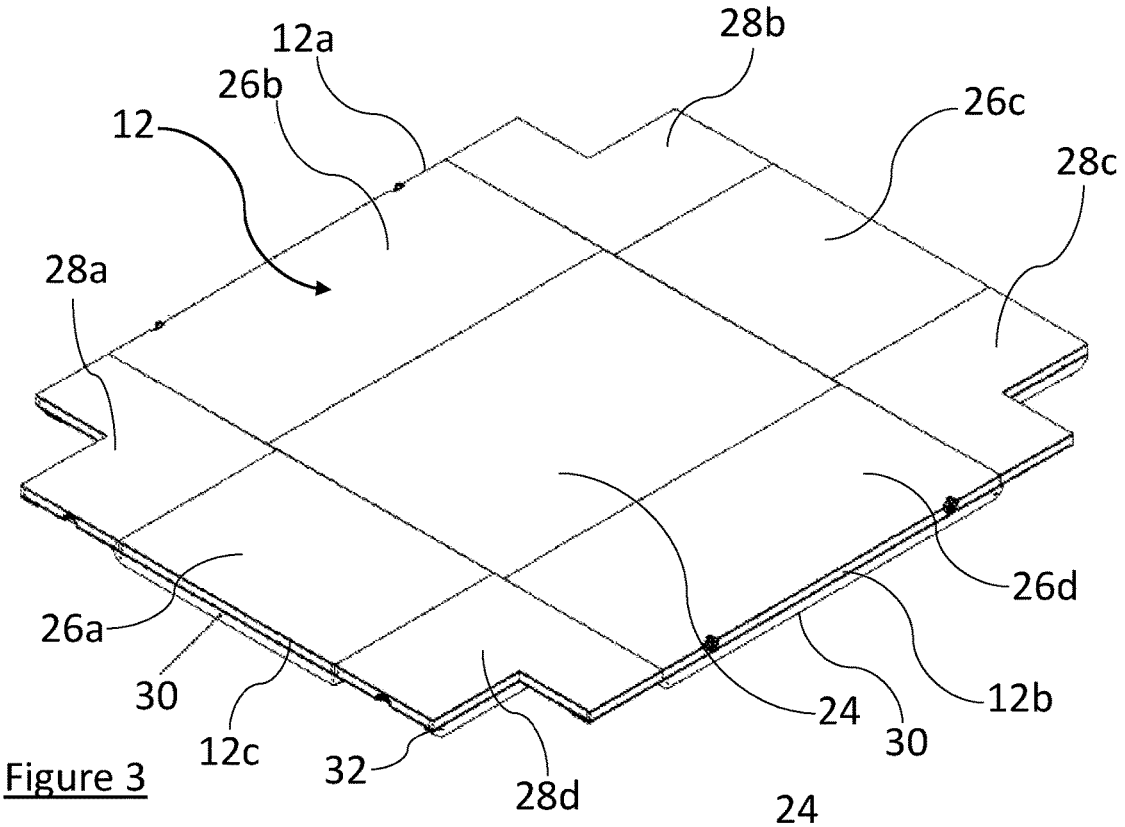
FIG. 3 is a perspective view of the floor of the structure illustrated in FIG. 1 with the floor panels in their open configuration.
Figure 4:
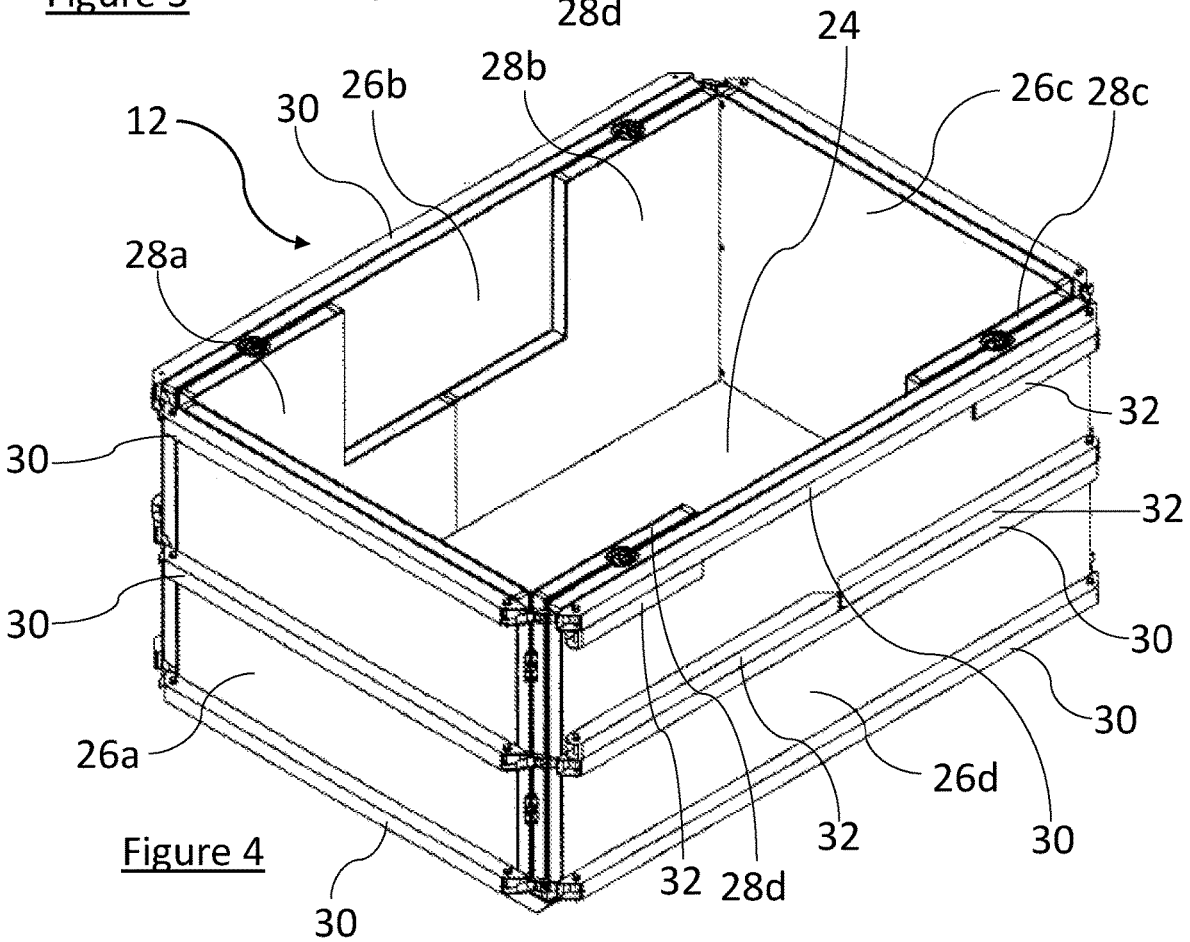
FIG. 4 is a perspective view of the floor of the structure illustrated in FIG. 1 with the floor panels in their closed configuration.
Figure 5:
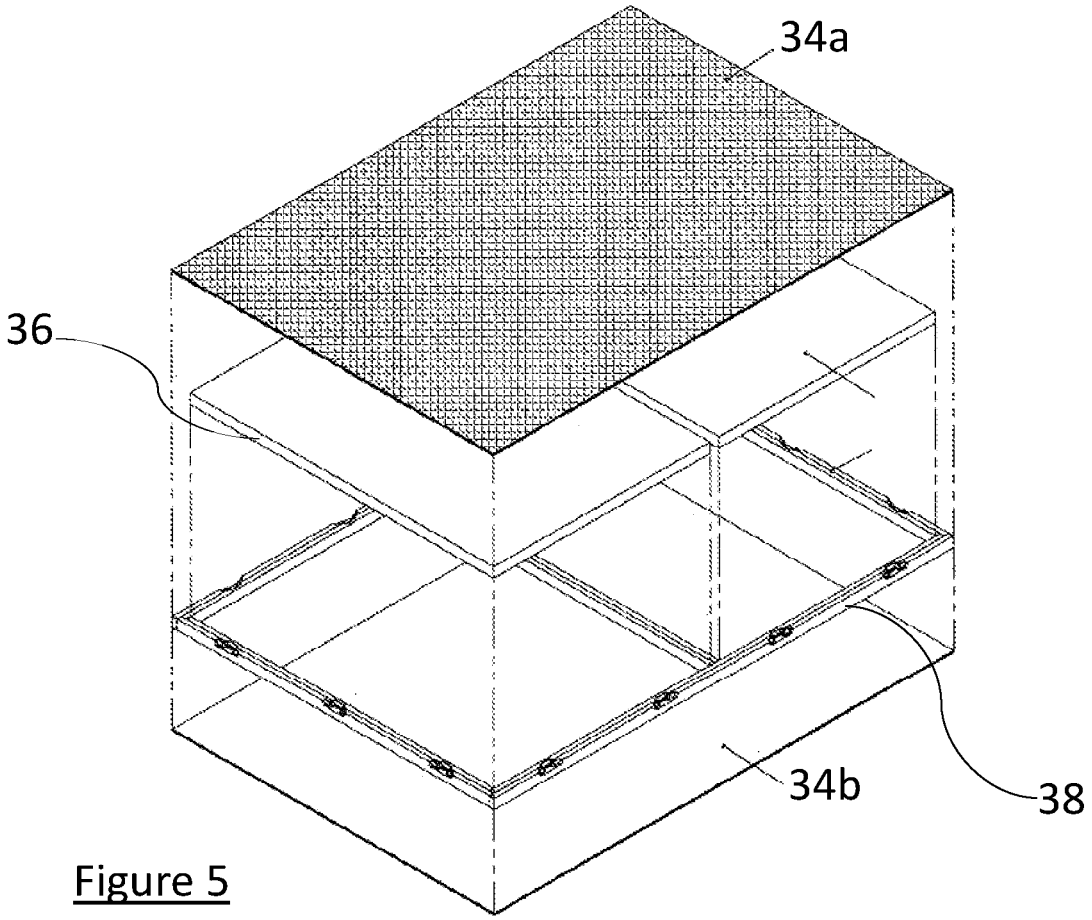
FIG. 5 is an exploded view of one of the floor panels illustrated in FIGS. 2 and 3.

The floor 12 is shown in more detail in FIGS. 3, 4 and 5.

The floor 12 comprises a plurality of interconnected substantially rigid floor panels 24, 26*a*, 26*b*, 26*c*, 26*d*, 28*a*, 28*b*, 28*c*, 28*d* which are connected together by a hinge mechanism, the hinge mechanism being operable such that the panels 24, 26*a*, 26*b*, 26*c*, 26*d*, 28*a*, 28*b*, 28*c*, 28*d* can be pivoted relative to one another between an open configuration in which they form a substantially planar floor, as illustrated in FIG. 3, and a closed configuration in which they form the base and sides of a container, as illustrated in FIG. 4.

The floor 12 has an upper surface which, when the floor panels 24, 26*a*, 26*b*, 26*c*, 26*d*, 28*a*, 28*b*, 28*c*, 28*d* are in the open configuration, is adjacent the interior space of the structure 10, and a lower surface which, when the structure is in use, is adjacent the ground. The upper surface of the floor 12 therefore forms the interior surface of the container when the floor panels 24, 26*a*, 26*b*, 26*c*, 26*d*, 28*a*, 28*b*, 28*c*, 28*d* are in their closed configuration. The hinge mechanism is configured and secured to adjacent floor panels 24, 26*a*, 26*b*, 26*c*, 26*d*, 28*a*, 28*b*, 28*c*, 28*d*, ideally in such a way that it lies between the adjacent floor panels 24, 26*a*, 26*b*, 26*c*, 26*d*, 28*a*, 28*b*, 28*c*, 28*d*. This ensures that the uppermost surface of the floor 12 is as smooth as possible, and the risk of a person moving round the interior space of the structure tripping over the hinge mechanism or part of the hinge mechanism is eliminated. This need not be the case, however, and a non-concealed hinge mechanism, which lies on and protrudes from the uppermost surface of the floor 12, could be used instead.

In this example, the structure comprises five rigid floor panels 24, 26*a*, 26*b*, 26*c*, 26*d* which, when in the closed configuration, form a base and four sides of the container. These rigid floor panels 24, 26*a*, 26*b*, 26*c*, 26*d* are generally rectangular and when in the closed configuration form an open topped container which encloses a cuboidal volume.

To achieve this, in this embodiment, one edge of each of the floor panels 26*a*, 26*b*,26*c*, 26*d* which form the sides of the container (hereinafter referred to as the side floor panels 26*a*, 26*b*, 26*c*, 26*d*) is connected, by means of a hinge mechanism, to one of the edges of the floor panel 24 which forms the base of the container (hereinafter referred to as the base floor panel 24). It will be appreciated that, when pivoted to the open configuration, the resulting floor 12 would form the shape of a cross.

In order to provide a substantially rectangular floor 12, in this embodiment, in addition to the five rectangular floor panels 24, 26*a*, 26*b*, 26*c*, 26*d*, there are four additional floor panels 28*a*, 28*b*, 28*c*, 28*d* which are each connected, by means of a hinge mechanism to one of the side floor panels 26*a*, 26*b*, 26*c*, 26*d*. These additional floor panels 28*a*, 28*b*, 28*c*, 28*d* fill in the spaces between the adjacent side floor panels 26*a*, 26*b*, 26*c*, 26*d*. The additional floor panels 28*a*, 28*b*, 28*c*, 28*d* could be square or rectangular, so that when the floor panels 24, 26*a*, 26*b*, 26*c*, 26*d*, 28*a*, 28*b*, 28*c*, 28*d* are unfolded, they form a substantially rectangular rigid panel. In this embodiment, however, the additional floor panels 28*s*, 28*b*, 28, 28*d* are generally L-shaped, so there is a small rectangular cut-out at each corner of the floor 12. This is provided to accommodate the enlarged tubular ribs 14*a* adjacent the end walls 20 of the structure 10 as illustrated in FIG. 2.

In this embodiment, the side floor panels 26*a*, 26*b*, 26*c*, 26*d* comprise two end panels 26*a*, 26*c* which are connected to the shorter edges of the base panel 24, and two side panels 26*b*, 26*d* which are connected to the longer edges of the base panel 24. Two of the additional panels 28*a*, 28*d* are secured to opposite edges of one of the end panels 26*a*, and the other two additional panels 28*b*, 28*c* are secured to opposite edges of the other of the end panels 26*c*. When the floor panels 24, 26*a*, 26*b*, 26*c*, 26*d*, 28*a*, 28*b*, 28*c*, 28*d* are in their closed configuration, two of the additional floor panels 28*a*, 28*b* lie flat along the interior face of one of the side panels 26*b*, while the other two of the additional panels 28*c*, 28*d* lie flat along the interior face of the other of the side panels 26*d*.

Although not shown in this example, the structure may comprise a further rigid floor panel which, when the floor panels 24, 26*a*, 26*b*, 26*c*, 26*d* are in the closed configuration, forms a lid of the container.

The structure may further be provided with container fasteners, such as straps, clips, latches or slide bolts, which are operable to secure the floor panels 24, 26*a*, 26*b*, 26*c*, 26*d*, 28*a*, 28*b*, 28*c*, 28*d* in the closed configuration, and which are releasable to allow the floor panels 24, 26*a*, 26*b*, 26*c*, 26*d*, 28*a*, 28*b*, 28*c*, 28*d* to unfold to the open configuration. The container fasteners may comprise one or more straps or belts which is/are fastened around the exterior of the side panels 26*a*, 26*b*, 26*c*, 26*d*. Alternatively, or additionally, the container fasteners may comprise clips, one or more clips being provided to connect each pair of adjacent edges of the side panels 26*a*, 26*b*, 26*c*, 26*d*.

When in the collapsed state, i.e. when the ribs 14*a* are deflated, the canopy 14 can be folded or rolled up and stored in the container formed by the floor panels 24, 26*a*, 26*b*, 26*c*, 26*d*, 28*a*, 28*b*, 28*c*, 28*d*. It will be appreciated that the canopy 14 is particularly vulnerable to being damaged to such an extent that the structure 10 no longer functions, as any hole or tear in the tubular ribs 14*a* will cause air to escape from the tubular ribs 14*a* when they are inflated. This could mean that air pressure in the ribs cannot reach a sufficiently high pressure for the ribs 14*a* to support the canopy 14 in the inflated state, or could cause the canopy to collapse over time from the inflated state. As such, it is important to protect the canopy 14 from damage during its storage or transportation. By using the floor 12 to as a rigid container for the canopy 14, the canopy 14 may be protected from damage, without the need to provide a separate crate, or container. As such, cost may be saved in storing and/or transporting the structure, as the weight and volume of the items to be stored and/or transported can be reduced.

The canopy 14 may be secured to the floor panels 24, 26*a*, 26*b*, 26*c*, 26*d*, 28*a*, 28*b*, 28*c*, 28*d*. For example, the outer periphery of the canopy 12 may be secured to the outer edges of the side floor panels 26*a*, 26*b*, 26*c*, 26*d* and additional floor panels 28*a*, 28*b*, 28*c*, 28*d* at the edges which form the first 12*a*, and second 12*b* of the floor 12.

The canopy 14 may be permanently secured to the floor panels 24, 26*a*, 26*b*, 26*c*, 26*d*, 28*a*, 28*b*, 28*c*, 28*d* and folded or stuffed into the container formed by the floor panels when in its collapsed state, so that once the floor panels 24, 26*a*, 26*b*, 26*c*, 26*d*, 28*a*, 28*b*, 28*c*, 28*d* are unfolded to form the substantially planar floor 12, the structure 10 is ready to erect by inflating the tubular ribs 14*a*. Alternatively, releasable canopy fasteners such as clips or hook and loop fasteners may be provided to secure the canopy 14 to the floor 12 when the floor panels 24, 26*a*, 26*b*, 26*c*, 26*d*, 28*a*, 28*b*, 28*c*, 28*d* are in their open configuration. This would allow a user to choose whether to detach the deflated canopy 14 from the floor 12 before folding the floor 12 and stowing the canopy 14 in the container formed by the folded floor panels 24, 26*a*, 26*b*, 26*c*, 26*d*, 28*a*, 28*b*, 28*c*, 28*d*, or to fold the floor panels 24, 26*a*, 26*b*, 26*c*, 26*d*, 28*a*, 28*b*, 28*c*, 28*d* and stow the deflated canopy 14 in the container with the canopy 14 still attached to the floor 12.

In this embodiment of the invention, the structure is further provided with a plurality of support rails 30, 32 which are secured to the lower surface of the floor 12 and which, when the structure 10 is in use, are configured to engage with the ground and support the floor 12 so that it is spaced from the ground. In this example, three support rails 30 which are spaced from and parallel to one another are mounted on the lower surface of each of the base floor panel 24 and four side floor panels 26*a*, 26*b*, 26*c*, 26*b*. So that the lower surface of the additional floor panels 28*a*, 29*b*, 28*c*, 28*d* can lie flat against the upper surface of the side floor panels 26*a*, 26*b*, 26*c*, 26*d* when the floor 12 is folded up, as illustrated in FIG. 3, an end of each of the support rails 32 for the additional floor panels 28*a*, 28*b*, 28*c*, 28*d* is pivotally connected to an adjacent side floor panel 26*a*, 26*b*, 26*c*, 26*d*, in such a way that as the floor panels 24, 26*a*, 26*b*, 26*c*, 26*d*, 28*a*, 28*b*, 28*c*, 28*d* are unfolded, these support rails 32 can be pivoted away from the side floor panel 26*a* 26*b*, 26*c*, 26*d* to which they are connected to engage with and support the lower surface of the additional floor panels 28*a*, 28*b*, 28*c*, 28*d*.

The support rails may be metallic, and may, for example be made from extruded aluminium.

The support rails 30 may reinforce and assist in strengthening the floor 12 and the container formed the floor panels 24, 26*a*, 26*b*, 26*c*, 26*d*, 28*a*, 28*b*, 28*c*, 28*d*, without significantly affecting its weight.

The support rails 30 on the side floor panels 26*a*, 26*b*, 26*c*, 26*d* are preferably arranged so that all are parallel to the edge of the base panel 24 to which the side panel 26*a*, 26*b*, 26*c*, 26*d* on which they are mounted is connected. This means that the support rails 30 on two opposite side floor panels 26*a*, 26*c* are substantially perpendicular to the support rails 30 on the other two opposite side floor panels 26*b*, 26*c* when the floor panels 24, 26*a*, 26*b*, 26*c*, 26*d*, 28*a*, 28*b*, 28*c*, 28*d* are in their open configuration.

To further strengthen the container, the support rails 30 on the side floor panels 26*a*, 26*b*, 26*c*, 26*d* are also arranged so that, when the floor panels 24, 26*a*, 26*b*, 26*c*, 26*d*, 28*a*, 28*b*, 28*c*, 28*d* are folded in their closed configuration, each end of a support rail 30 is directly adjacent to an end of a support rail 30 on an adjacent side floor panel 26*a*, 26*b*, 26*c*, 26*d*. The container fasteners (not shown) or additional releasable fasteners, such as straps, clips, latches or slide bolts, are advantageously provided to connect the end of one support rail 30 with the end of the adjacent support rail 30 on the adjacent side panel 26*a*, 26*b*, 26*c*, 26*d* to hold or assist in holding the floor panels 24, 26*a*, 26*b*, 26*c*, 26*d*, 28*a*, 28*b*, 28*c*, 28*d* in their closed configuration.

Moreover, in spacing the base panel 24 from the ground when the floor panels 24, 26*a*, 26*b*, 26*c*, 26*d*, 28*a*, 28*b*, 28*c*, 28*d* are in their closed configuration, the support rails 30 allow the forks of a fork lift truck to be inserted under the container, thus allowing the container to be lifted by a fork lift truck without having to place it on a separate palate.

Once the tubular ribs 14*a* have been inflated to the desired pressure, the source of compressed air may be detached from the air inlet port 15, and the air inlet port 15 plugged. However, it is likely that, over time, the air pressure in the tubular ribs 14*a* will not stay at the desired level. There may be points at which air can leak slowly out of the tubular ribs 14*a* so that the air pressure therein reduces slowly over time until the structure 10 collapses. To reduce the risk of this occurring, the structure 10 may be further provided with a pressure return monitoring system (hereinafter referred to as a PRMS) which operates automatically to maintain the air pressure in the tubular ribs 14*a* between predetermined limits.

The PRMS may comprise a settable pressure activated switch, and an electrically operated air blower or pump or other source of pressurised air (such as a compressed air cylinder). The air blower/source of pressurised air may be connected to the interior of the tubular ribs 14*a* via a non-return valve and the air inlet port 15, or by an alternative inflation inlet port (not shown). The pressure switch is connected to the interior of the tubular ribs 14*a* via a separate, smaller diameter flexible tube (such as a tube 6 mm in diameter), and is configured such that when activated by pressure in the tubular ribs 14*a* exceeding a predetermined upper pressure threshold, it closes an electrical contact, and opens the electrical contact when the pressure in the tubular ribs 14*a* falls below a predetermined lower pressure threshold. Where an air blower or pump is provided, the electrical contact is connected to the air blower such that when the contact is closed, the air blower operates to blow more air into the interior of the tubular ribs 14*a*, and when the contact is open, the air blower does not operate. Alternatively, the electrical contact may be connected to an electrically operable valve provided in the connection between the source of pressurised air and the interior of the tubular rib, so that when the contact is closed, the valve operates to allow flow of air from the source of pressurised air, into the interior of the tubular rib 14*a*, and when the contact is open, closes the valve to prevent flow of air from the source of pressurised air into the interior of the tubular rib 14.

Alternatively, an electronic PRMS may be provided, comprising an electronic pressure sensor, an electrical switch, and an electrically operated air blower or pump or other source of pressurised air (such as a compressed air cylinder). Again, the air blower/source of pressurised air may be connected to the interior of the tubular ribs 14*a* via a non-return valve and the air inlet port 15, or by an alternative inflation inlet port (not shown). The pressure sensor is connected to the interior of the tubular ribs 14*a* via a separate, smaller diameter flexible tube (such as a tube 6 mm in diameter). Where an air blower or pump is provided, the switch is connected to the air blower such that when the switch is closed, the air blower operates to blow more air into the interior of the tubular ribs 14*a*, and when the switch is open, the air blower does not operate. Alternatively, the switch may be connected to an electrically operable valve provided in the connection between the source of pressurised air and the interior of the tubular rib, so that when the switch is closed, the valve operates to allow flow of air from the source of pressurised air, into the interior of the tubular rib 14*a*, and when open closes the valve to prevent flow of air from the source of pressurised air into the interior of the tubular rib 14.

The switch receives a signal from the pressure sensor which represents the air pressure in the tubular ribs 14*a*, and is configured to close the switch when the signal from the pressure sensor indicates that the air pressure in the tubular ribs 14*a* has fallen below a predetermined lower threshold level, and to open the switch when the pressure in the tubular ribs 14*a* reaches a pre-determined higher threshold level.

This may be achieved by connecting the electronic pressure sensor and switch to an appropriately programmed electronic control unit. In this case, the electronic control unit may comprise a user input device such as a key pad or touch screen, by means of which a user may change the programmed upper and lower threshold levels.

When inflatable structures such as this are used in a hot and/or sunny environment, increases in the temperature of the tubular ribs 14*a* can cause the air inside the tubular ribs 14*a* to expand. In fact, there may be sufficient expansion of the air inside the tubular ribs 14*a* that the air pressure in the tubular ribs 14*a* reaches sufficiently high levels that it damages the structure 10, for example by causing one or more of the tubular ribs 14*a* to tear at one or more of its seams. In this case, it may be desirable to include one or more pressure relief valves by means of which air can be exhausted from the tubular ribs 14*a*. The pressure relief valve could be mechanically operated, and set to open when the pressure in the tubular ribs 14*a* exceeds a pre-set level which is slightly higher than the normal operating pressure. For example, this may be a one-way valve with a valve member which is biased to a closed position by means of a spring, and which opens when the force exerted on the valve member by the air pressure inside the tubular ribs 14*a* is sufficient to overcome the biasing force of the spring.

Alternatively, where the structure is provided with an electronic PRMS as described above, the or each pressure relief valve could be an electrically operable quick release valve which is incorporated in the PRMS, and the PRMS being configured to open the quick release valve to release air from the interior of the tubular ribs 14*a* if the pressure detected by the pressure sensor exceeds a pre-determined limit (which is slightly higher than the normal upper threshold level used to trigger the opening of the switch), and then to close the quick release valve when the pressure detected by the pressure sensor falls below a pre-determined level (which is between the upper and lower threshold level used in triggering the opening or closing of the switch).

For redundancy purposes, in case the PRMS fails, the structure 10 may be provided with a second PRMS, and/or back-up mechanical pressure relief valves.

In order to be used as a temporary cold storage facility, the structure 10 may further comprise a refrigeration apparatus (not shown) which is operable to extract air from the interior space, cool the extracted air, and then return the cooled air to the interior space. In this case, the structure is advantageously provided with a refrigeration port and a coupling by means of which the refrigeration apparatus may be placed outside the interior space but connected to the interior space so that the refrigeration apparatus can be operated to extract and cool air from the interior space, and return the cooled air to the interior space. In this example, the refrigeration port is provided in the opposite end wall to the end wall 20 in which the doorway 22 is provided.

In order to ensure that air as much as possible of the air from the interior space that passes through the refrigeration port enters the refrigeration unit, the end wall around the refrigeration port may be provided with a sealing arrangement to secure the end wall to the refrigeration unit, and ensure a substantially air tight seal between the two. This sealing arrangement may comprise mechanical clips and/or hook and look fasteners.

The floor panels 24, 26*a*, 26*b*, 26*c*, 26*d*, 28*a*, 28*b*, 28*c*, 28*d* are advantageously size such that when folded into their closed configuration, the resulting container is large enough to house both the deflated canopy and the refrigeration apparatus. This may facilitate easy storage and transportation of the entire assembly—structure 10 and refrigeration unit, which could be particular advantageous when it is to be shipped to a remote location, for example for use in disaster relief.

Where the structure 10 is intended for use as a temporary cold storage facility, the structure 10 is advantageously insulated to minimise the load on the refrigeration apparatus and assist in maintaining the interior space at the desired low temperature.

For example, in one embodiment, the floor panels 24, 26*a*, 26*b*, 26*c*, 26*d*, 28*a*, 28*b*, 28*c*, 28*d* are made from two parallel outer skin panels 34*a*, 34*b* with a floor insulating layer of thermally insulating material 36 therebetween, as illustrated in FIG. 5. In this example, the skin panels 34*a*, 34*b* are made from anti-slip phenolic coated plywood, with the outer skin panels 34*a*, 34*b* being arranged such that the anti-slip phenolic coating provides the upper and lower surfaces of each floor panel 24, 26*a*, 26*b*, 26*c*, 26*d*, 28*a*, 28*b*, 28*c*, 28*d*. The floor insulating layer may be made from a polymer and may have an open or closed cell structure. It may be flexible, but advantageously it is rigid, in order to assist in achieving the desired rigidity of the floor 12. In one example, the insulating layer 36 is made from high performance rigid extruded polystyrene insulation. The insulating layer 36 may alternatively made from a woven or non-woven fibrous insulating material such as mineral or rock wool, or a felt made from polymeric fibres.

The insulating nature of the floor 12, combined with the elevation of the floor 12 above the ground by the support rails 30,32 may prevent the ground below the structure 10 from being damaged by the lower temperature of the air in the interior space of the structure 10.

In order to protect the plywood and insulating layer from damage caused by moisture, the outer skins 34*a*, 34*b* and insulating layer 36 are mounted in a rectangular frame 38, a substantially fluid tight seal being provided between the frame 38 and the phenolic coatings on the upper and lower surfaces of the outer skin panels 34*a*, 34*b*.

Additionally or alternatively, the end walls 20 may be double layered, and comprise two polymeric (e.g. PVC) skin layers with a thermally insulating lining therebetween. The thermally insulating lining could be made from a woven or non-woven fibrous material, or from a flexible sheet of polymeric, open or closed-cell foam. In one embodiment, the thermally insulating lining used in the end walls is a flexible multi-foil insulation such as Actis™ Triso Super 10+, which comprises layers of a polymeric fleece or felt sandwiched between thin metal foil.

The use of air filled tubular ribs in the roof 16 and side walls 18*a*, 18*b* assists in thermally insulating the interior space. The insulating properties of the canopy 14 may be further improved by providing a rib insulating layer 40 of flexible insulating material inside each tubular rib 14*a*. An example of the transverse cross-section through one of the tubular ribs 14*a* when inflated is illustrated schematically in FIG. 6.

The rib insulating layer 40 may be made from a thermo-reflective insulation material which comprises at least one reflective foil layer. It may, for example be made from a multifoil insulation in which two or more foil layers are provided either side of an insulating core made of a fibrous material such as glass, rock or mineral wool, or a polymeric bubble insulation. An example of a suitable insulation material is Actis™ Triso-Super 10+.

Alternatively or additionally, the ability of the canopy 14 to assist the refrigeration apparatus in maintaining the interior space at the desired low temperature may be further improved by coating the tubular ribs 14*a* with a blackout coating designed to minimise solar transmission through the tubular ribs 14*a*, and/or a reflective coating to maximise the reflection of sunlight off the structure 10.

Figure 6:
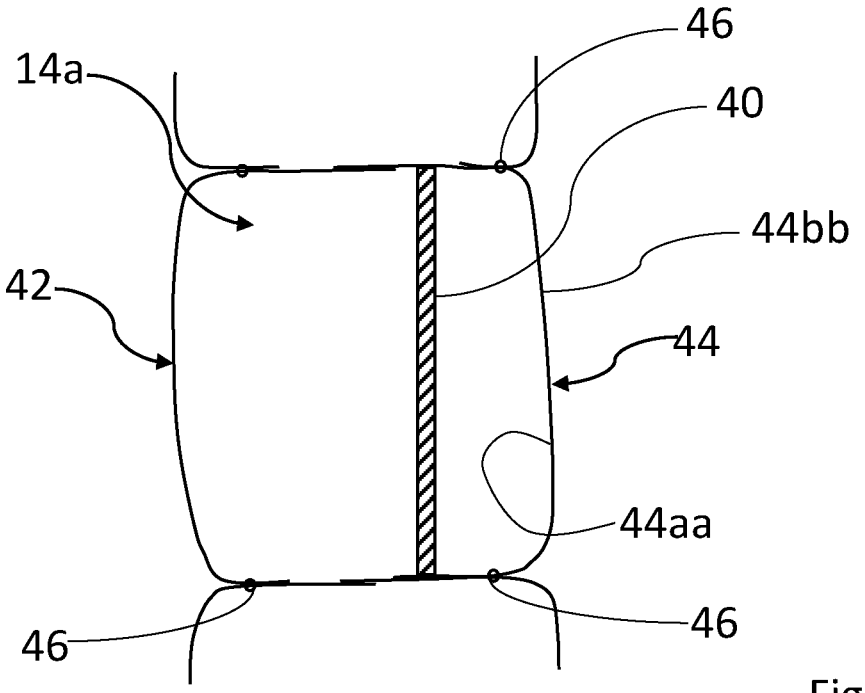
FIG. 6 is a schematic illustration of the transverse cross-section through one of the tubular ribs of the structure illustrated in FIG. 1.

As illustrated in FIG. 6, each tubular rib 14*a* has an inner skin 42 which encloses the interior space of the structure 10 when the canopy 14 is inflated, and an outer skin 44 which is in contact with environment at the exterior of the structure 10. Together the inner skin 42 and outer skin 44 form a tube with a substantially circular transverse cross-section when inflated. Preferably the interior surface 44*aa* of the outer skin 44 is coated with a blackout coating, whilst the exterior surface 44*bb* of the outer skin 44 is coated with a coating which maximises the reflection of sunlight off the tubular ribs 14*a*. As a result solar reflection off the exterior surface of the outer skin 44 of the tubular ribs 42 may be enhanced, and solar transmission through the outer skin 44 may be reduced, and therefore solar heating of the air inside the tubular ribs 14*a*, and hence also the air in the interior space of the structure 10, may be reduced.

In this embodiment, both sides of the inner skin 42 and outer skin 44 are coated white PVC, whilst an additional blackout coating, which may be a black PVC coating, is provided on the interior surface 44*aa* of the outer skin 44.

The tubular ribs 14*a* may be made as follows. The inner skin 42 and outer skin 44 are each made from a separate strip of the air impermeable flexible sheet material. Each strip may be made from a single piece of the material, but in this embodiment, each strip is made up of a plurality of separate rectangular or square pieces which are connected together, end to end, by hot-air welding. Two strips of skin are then placed side by side, and their long edges long edges sewn together with a line of stitching 46 which runs generally parallel to the long edges of the two strips of skin.

The distance between the line of stitching 46 and the adjacent long edge of the strip of skin is greater for one strip than the other.

Figure 7:
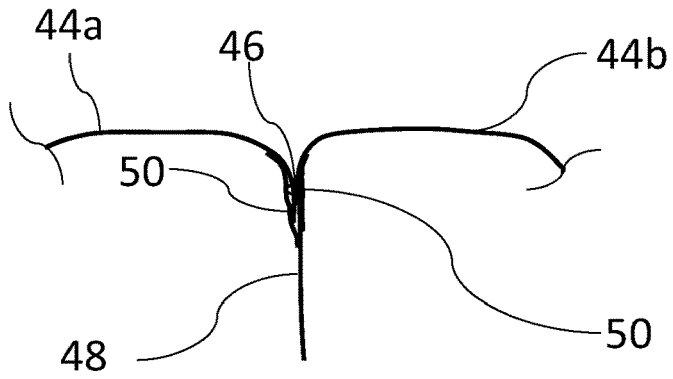
FIG. 7 is a transverse cross-section through a portion of the join between two adjacent tubular ribs of the structure illustrated in FIG. 1.

This is illustrated in FIG. 7, which shows a schematic illustration of a transverse cross-section through the two adjacent strips of outer skin 44*a*, 44*b*. In the case, the distance between the line of stitching 46 and the adjacent long edge of the first strip of outer skin 44*a* is less than the distance between the line of stitching 46 and the adjacent long edge of the second strip of outer skin 44*b*. The portion of the second strip of outer skin 44*b* and the line of stitching 46 will form part of a partition between adjacent tubular ribs 14*a*, and therefore is hereinafter referred to as the partition strip 48.

The apertures formed during the stitching process could provide a path for leakage of air out of the tubular ribs 14*a*, and therefore these are sealed by hot air welding a sealing tape 50 over both sides of the stitching.

Figure 8:
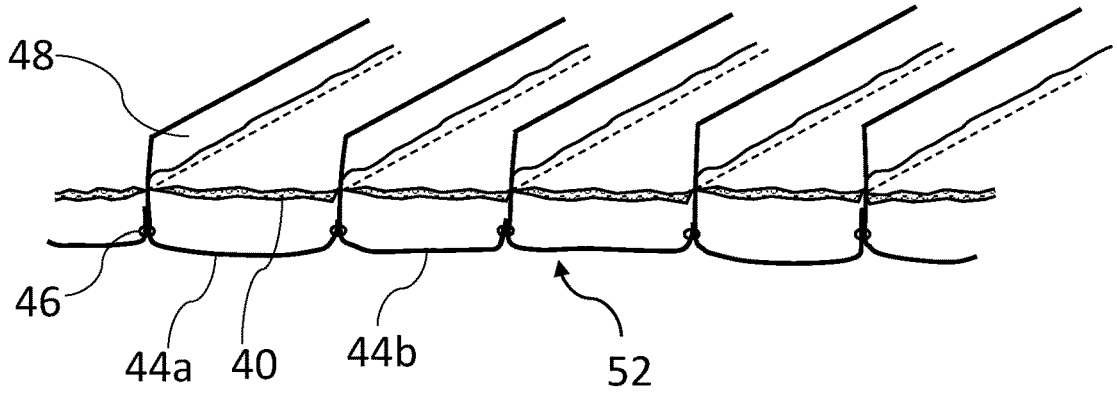
FIG. 8 is a perspective view of a transverse cross-section through a plurality of outer strips joined to form an exterior sheet for the canopy of the structure illustrated in FIG. 1.

This process is then repeated for all the strips of outer skin 44 required to form the tubular ribs 14*a* of the structure 10, to create an exterior sheet 52 which will form the exterior facing surface of the roof 16 and side walls 18*a*, 18*b* of the structure 10, as illustrated in FIG. 8.

Figure 10:
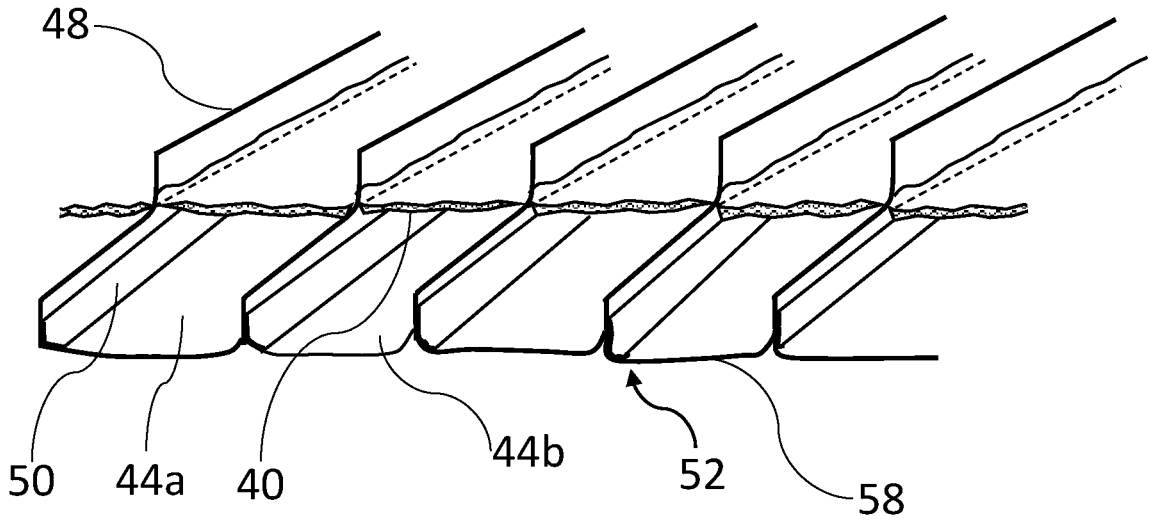
FIG. 10 is a perspective view of an edge of the exterior sheet illustrated in FIG. 8.

At the ends of the strips of outer skin 44, the partition strip 48 is either cut away so that the edge of the second strip of outer skin 44*b* is generally aligned with the adjacent edge of the first strip of outer skin 44*a*, or the piece of material used to form the ends of each strip of outer skin 44 is shaped in advance to achieve this result. The adjacent ends of all the outer skin strips align to form two opposite tube end edges 58 of the exterior sheet 52, the stitching between the adjacent strips of outer skin 44 extending all the way to the tube edges 58 of the exterior sheet 52. This is illustrated in FIG. 10.

Where provided, the rib insulating layers 40 are then stitched onto the sheet 52. To achieve this, a strip of the insulating material used to provide the rib insulating layer 40 is placed in each gap between adjacent partition strips 48, and the long edges of each strip of insulating material is stitched to the adjacent partition strips 48. This is illustrated in FIGS. 8, 9 and 10.

The same process is repeated with strips of inner skin 42*a*, 42*b* to create an interior sheet 54 which will form the interior facing surface of the roof 16 and side walls 18*a*, 18*b* of the structure 10. In this case, however, no insulating material is stitched to the partition strips 48.

Figure 9:
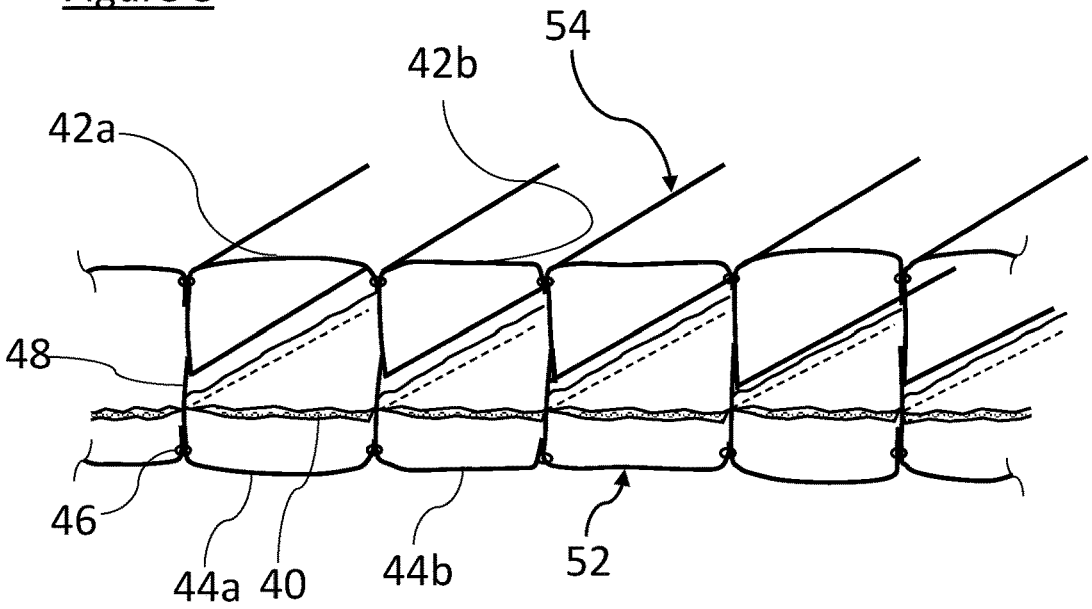
FIG. 9 is a perspective view of a transverse cross-section through a portion of the exterior sheet and interior sheet joined to form tubular ribs of the canopy of the structure illustrated in FIG. 1.

To form the tubular ribs 14*a*, each partition strip 48 of the exterior sheet 52 is hot air welded to a corresponding partition strip 48 of the interior sheet 54, as illustrated in FIG. 9. The partition strip 48 of the interior sheet 54 may have to be gathered or pleated during this process to provide the tubular ribs 14*a* with the desired shape, in this example to provide the bends between the side walls 18*a*, 18*b* and the roof 20, the ridge 20*a* of the roof 20 etc.

Figure 11:
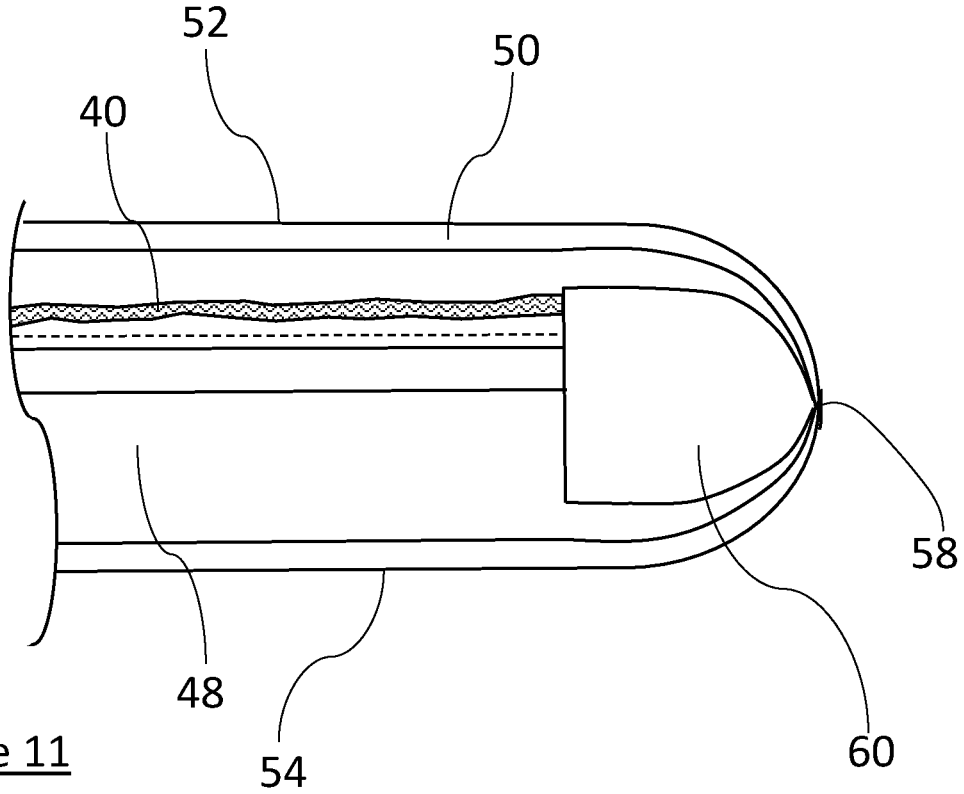
FIG. 11 is a side view of a longitudinal cross-section of an end portion of one of the tubular ribs of the canopy of the structure illustrated in FIG. 1.

Finally, the ends of the tubular ribs 14*a* are sealed by hot air welding each end edge 58 of the exterior sheet 52 to the adjacent end edge of the interior sheet 54 as illustrated in FIG. 11. A piece of sacrificial material may be placed inside to prevent the end edges 58 from becoming welded to other parts of the canopy during this process.

In this case, as the tubular ribs 14*a* are intended to form substantially planar side walls 18*a*, 18*b* and sections of roof 20, the strips of inner skin 42 are the same width as the strips of outer skin 44. If the tubular ribs 14*a* were intended to be secured to a curved edge of floor 12, or to continue round a corner of the floor 12 (for example if the end walls 20 were also formed from tubular ribs 14*a*), it would be necessary to vary the relative width of the strip of inner skin 42 relative to the width of the strip of outer skin 44 in some or all of the pairs of strips. For example, if the outer periphery of the floor 12 were circular, the desired curve in the side walls 18*a*, 18*b* could be achieved by making all the strips of inner skin 42 narrower than the strips of outer skin 44. Similarly, if the tubular ribs 14*a* were to continue round a corner, this could be achieved by making the strip of inner skin 42 forming the tubular rib 14*a* at the corner narrower than the corresponding strip of outer skin 44.

Finally, the tubular ribs 14*a* are sealed by bending the end edge 58 of the exterior sheet 52 and the end edge 58 of the interior sheet 54 towards one another, and hot air welding them together, as illustrated in FIG. 11. This results in the formation of a two end tubes 60 which extend perpendicular to the tubular ribs 14*a* and lie at either end thereof. Either end of each of the end tubes 60 is also sealed by hot air welding the edges of the exterior and interior sheets 52, 54 together. The resulting seams may be strengthened by hot air welding a sealing tape along each seam.

The space between the exterior sheet 52 and interior sheet 54 is therefore completely sealed, the interiors of the tubular ribs 14*a* being connected by the two end tubes 60. This means that the tubular ribs 14*a* can all be inflated by providing a single air inlet port 15 located in one of the ribs 14*a* or one of the end tubes 60.

By extending the stitching 46 between adjacent strips of inner and outer skin 42, 44 all the way to the end edges 58, the stitching 46 becomes part of the hot air welded seams, and therefore the risk of leakage of air from the tubular ribs 14*a* where the stitching 46 ends may be reduced.

The invention claimed is:

1. A structure comprising a floor, and a collapsible canopy made from a substantially air-impermeable material and having at least one tubular rib, the canopy being further provided with an air inlet port by means of which the interior of the at least one tubular rib can be connected to a source of compressed air, and being movable by the supply of compressed air to the tubular rib via the air inlet port from a collapsed state in which the at least one tubular rib is deflated to an inflated state in which the at least one tubular rib is inflated and supports the canopy in such a way that the canopy encloses an interior space above the floor and forms a roof and side walls of the structure, wherein a rib insulating layer is provided in the interior of each rib of the at least one tubular rib, wherein the rib insulating layer comprises a polymeric fleece or felt sandwiched between two reflective foil layers.

2. A structure according to claim 1 wherein each tubular rib of the at least one tubular rib has an interior skin which faces the interior space enclosed by the canopy, and an exterior skin which faces the exterior of the structure, the space between the interior skin and exterior skin forming the interior of the tubular rib, the exterior surface of the exterior skin being provided with reflective coating.

3. A structure according to claim 2 wherein the interior surface of the exterior skin is provided with a coating to reduce transmission of solar energy through the exterior skin into the interior of the tubular rib.

4. A structure according to claim 1 wherein the structure is further provided with a pressure activated switch which is reacts to the air pressure in the at least one tubular rib, and a source of pressurised air, the pressure activated switch being configured to operate to initiate supply of pressurised air from the source of pressurised air to the interior of the at least one tubular rib if the pressure in the interior of the at least one tubular rib falls below a pre-determined lower threshold, and to cease the supply of pressurised air from the source of pressurised air to the interior of the at least one tubular rib when the pressure in the interior of the at least one tubular rib reaches a pre-determined upper threshold.

5. A structure according to claim 1 wherein the structure is further provided with a pressure relief valve which is configured to allow air to be exhausted from the interior of the at least one tubular rib if the pressure in the interior of the at least one tubular rib falls above a pre-determined upper threshold, and to stop the release of air from the interior of the at least one tubular rib when the pressure in the interior of the at least one tubular rib reaches a pre-determined lower threshold.

6. A structure according to claim 5 further comprising a source of pressurised air, and a pressure operated switch which is configured to initiate supply of pressurised air from the source of pressurised air to the interior of the at least one tubular rib if the pressure in the interior of the at least one tubular rib falls below a second pre-determined lower threshold, and to cease the supply of pressurised air from the source of pressurised air to the interior of the at least one tubular rib when the pressure in the interior of the at least one tubular rib reaches a second pre-determined upper threshold.

* * * * *